US009442452B2

(12) United States Patent
Ohata et al.

(10) Patent No.: US 9,442,452 B2
(45) Date of Patent: Sep. 13, 2016

(54) IMAGE FORMING APPARATUS COMPRISING CONNECTING MECHANISM CONFIGURED TO ELECTRICALLY CONNECT HIGH-VOLTAGE BOARD AND UNIT

(71) Applicant: KYOCERA Document Solutions Inc., Osaka (JP)

(72) Inventors: Shinobu Ohata, Osaka (JP); Keiji Okumura, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/877,589

(22) Filed: Oct. 7, 2015

(65) Prior Publication Data

US 2016/0098006 A1 Apr. 7, 2016

(30) Foreign Application Priority Data

Oct. 7, 2014 (JP) ..... 2014-206611

(51) Int. Cl.

| | |
|---|---|
| ***G03G 15/00*** | (2006.01) |
| ***G03G 21/18*** | (2006.01) |
| ***G03G 21/16*** | (2006.01) |
| *H01B 5/04* | (2006.01) |

(52) U.S. Cl.

CPC ..... *G03G 15/80* (2013.01); *G03G 21/1652* (2013.01); *G03G 21/1867* (2013.01); *H01B 5/04* (2013.01)

(58) Field of Classification Search

CPC ..... G03G 15/80; G03G 21/1867; G03G 21/1652; H01B 5/04

See application file for complete search history.

(56) References Cited

U.S. PATENT DOCUMENTS

| | | | | |
|---|---|---|---|---|
| 2006/0153587 | A1* | 7/2006 | Omura | G03G 15/50 399/89 |
| 2009/0214245 | A1* | 8/2009 | Ito | G03G 15/80 399/88 |
| 2010/0239304 | A1* | 9/2010 | Sato | G03G 21/1652 399/90 |
| 2014/0133881 | A1* | 5/2014 | Tada | G03G 15/80 399/90 |
| 2014/0376946 | A1* | 12/2014 | Souda | G03G 21/16 399/90 |
| 2015/0378303 | A1* | 12/2015 | Ohata | G03G 15/80 399/90 |

FOREIGN PATENT DOCUMENTS

JP 2013-250326 A 12/2013

* cited by examiner

*Primary Examiner* — David Gray
*Assistant Examiner* — Laura Roth
(74) *Attorney, Agent, or Firm* — Studebaker & Brackett PC

(57) ABSTRACT

An image forming apparatus includes a unit, a high-voltage board and a connecting mechanism. The connecting mechanism includes a first connecting member, a first holding member, a coupling member and a second connecting member. The first connecting member includes a first spring terminal. The first spring terminal includes a first large diameter part and a first small diameter part. The first holding member has a first contact part coming into contact with an end part of the first small diameter part at a side of the first large diameter part in a state where the first holding member is coupled with the coupling member. The coupling member has a second contact part coming into contact with an end part of the first large diameter part at a side of the first small diameter part in the state where the first holding member is coupled with the coupling member.

8 Claims, 12 Drawing Sheets

IMAGE FORMING APPARATUS COMPRISING CONNECTING MECHANISM CONFIGURED TO ELECTRICALLY CONNECT HIGH-VOLTAGE BOARD AND UNIT

INCORPORATION BY REFERENCE

This application is based on and claims the benefit of priority from Japanese patent application No. 2014-206611 filed on Oct. 7, 2014, the entire contents of which are incorporated herein by reference.

BACKGROUND

The present disclosure relates to an electrographic image forming apparatus.

Conventionally, an electrographic image forming apparatus includes various units, such as a photosensitive drum unit, a developing unit and a transferring unit, and so on. These units are used for an image forming process on a recording medium.

For example, an image forming apparatus, which includes a unit used for an image forming process on a recording medium, a high-voltage board configured to supply a high-voltage current to the unit and a connecting mechanism configured to connect the high-voltage board and the unit, is known.

There is a case that a high-voltage contact is formed by a pair of spring terminals at an inside of the connecting mechanism. In such a case, it is necessary to consider the spring pressures of both spring terminals when the pressure of the high-voltage contact is set and it is difficult to set the pressure of the high-voltage contact easily and precisely.

SUMMARY

In accordance with an embodiment of the present disclosure, an image forming apparatus includes a unit, a high-voltage board and a connecting mechanism. The unit is used for an image forming process on a recording medium. The high-voltage board is configured to supply a high-voltage current to the unit. The connecting mechanism is configured to electrically connect the high-voltage board and the unit. The connecting mechanism includes a first connecting member, a first holding member, a coupling member and a second connecting member. The first connecting member includes a first spring terminal. The first holding member is configured to hold the first connecting member. With the coupling member, the first holding member is coupled. The second connecting member includes a second spring terminal configured to be contactable with the first spring terminal. The first spring terminal includes a first large diameter part and a first small diameter part. The first large diameter part is composed of a compressible coil spring. The first small diameter part is composed of a tightly wound coil spring, has a smaller outer diameter than the first large diameter part and is configured to be contactable with the second spring terminal. The first holding member has a first contact part configured to come into contact with an end part of the first small diameter part at a side of the first large diameter part in a state where the first holding member is coupled with the coupling member. The coupling member has a second contact part configured to come into contact with an end part of the first large diameter part at a side of the first small diameter part in the state where the first holding member is coupled with the coupling member.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
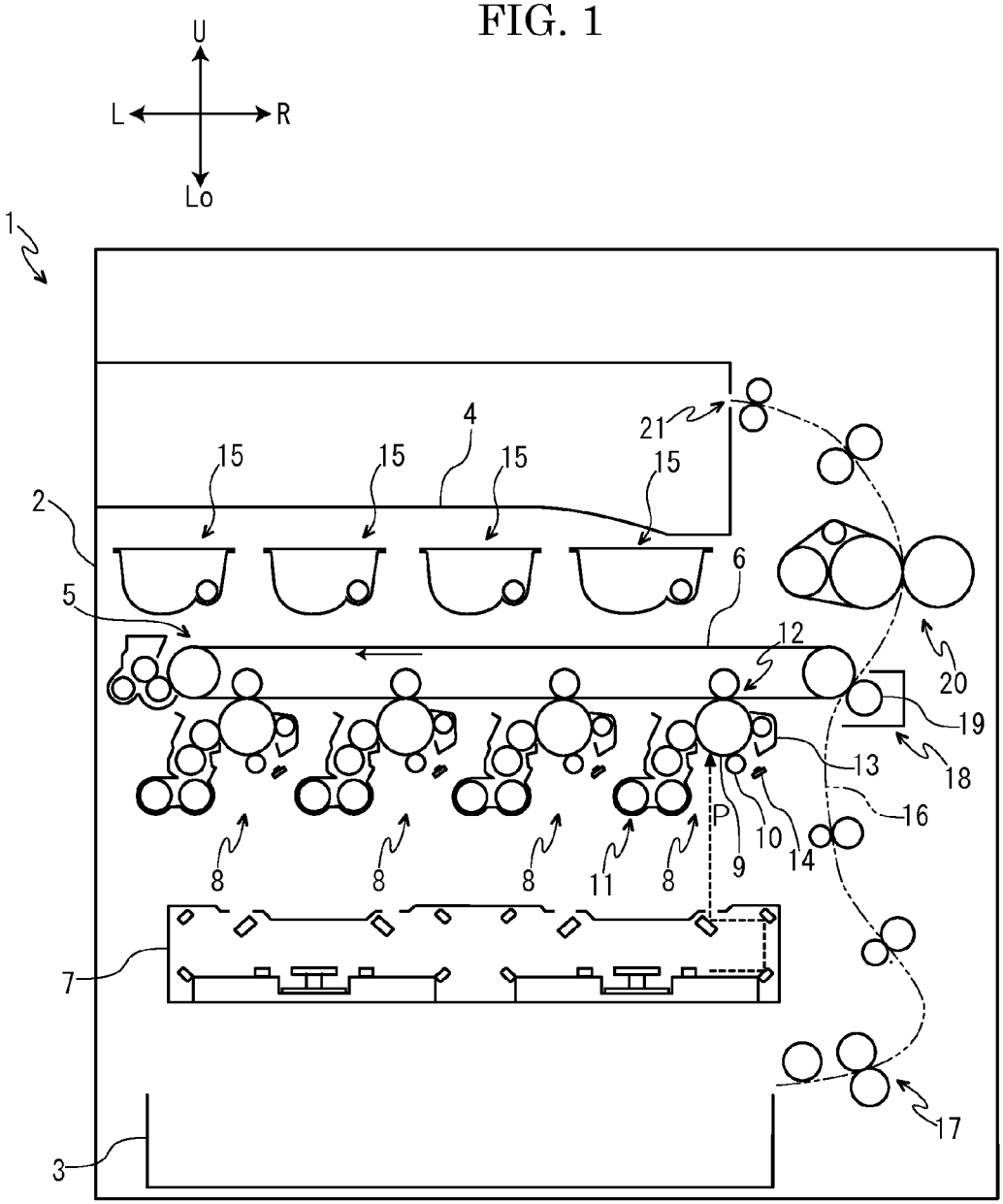
FIG. 1 is a schematic diagram showing an outline of a configuration of a color printer according to an embodiment of the present disclosure.

Firstly, with reference to FIG. 1, the entire structure of a color printer 1 (an image forming apparatus) will be described. Hereinafter, a near side of FIG. 1 will be described as a front side of the color printer 1, for convenience of explanation. Arrows Fr, Rr, L, R, U and Lo of each figure indicate a front side, a rear side, a left side, a right side, an upper side and a lower side of the color printer 1, respectively.

The color printer 1 includes a box-formed printer main body 2 (apparatus main body). In a lower part of the printer main body 2, a sheet feeding cartridge 3 storing a sheet (a recording medium) is arranged. In an upper part of the printer main body 2, an ejected sheet tray 4 is arranged.

In a middle part of the printer main body 2, an intermediate transferring unit 5 is arranged. The intermediate transferring unit 5 is provided with an intermediate transferring belt 6 (image carrier) disposed around a plurality of rollers. Below the intermediate transferring belt 6, an exposure device 7 composed of a laser scanning unit (LSU) is arranged. At a lower side of the intermediate transferring belt 6, four image forming parts 8 are arranged for respective colors (e.g. four colors of magenta, cyan, yellow and black) of a toner. In each image forming part 8, a photosensitive drum 9 is rotatably arranged. Around the photosensitive drum 9, a charger 10, a developing device 11, a primary transferring part 12, a cleaning device 13 and a static eliminator 14 are located in order of first transferring processes. Above the developing device 11, toner containers 15 corresponding to the respective image forming parts 8 are arranged for the respective colors (e.g. four colors of magenta, cyan, yellow and black) of toner.

At a right side part of the printer main body 2, a conveying path 16 for the sheet is arranged in upper and lower direction. At an upstream end of the conveying path 16, a sheet feeding part 17 is arranged. At an intermediate stream part of the conveying path 16, a secondary transferring unit 18 (unit) is arranged at a right end side of the intermediate transferring belt 6. The secondary transferring unit 18 includes a secondary transferring roller 19. At a downstream part of the conveying path 16, a fixing device 20 is arranged. At a downstream end of the conveying path 16, a sheet ejection port 21 is arranged.

Next, an image forming process on the sheet in the color printer 1 having such a configuration will be described.

When the power is supplied to the color printer 1, various parameters are initialized and initial determination, such as temperature determination of the fixing device 20, is carried out. Subsequently, when image data is inputted and a printing start is directed from a computer or the like connected with the color printer 1, the image forming process on the sheet is carried out as follows.

Firstly, the surface of the photosensitive drum 9 is electrically charged by the charger 10. Then, an electrostatic latent image is formed on the surface of the photosensitive drum 9 by a laser light (refer to an arrow P) from the exposure device 7. The electrostatic latent image is developed to a toner image in the developing device 11 by the toner supplied from each toner container 15. The toner image is primarily transferred to the surface of the intermediate transferring belt 6 in the primary transferring part 12. The above-mentioned operation is repeated in order by the respective image forming parts 8, thereby forming the toner image of full color on the intermediate transferring belt 6. Incidentally, toner and electric charge remained on the photosensitive drum 9 are removed by the cleaning device 13 and the static eliminator 14.

On the other hand, the sheet fed from the sheet feeding cartridge 3 or a manual bypass tray (not shown) by the sheet feeding part 17 is conveyed to the secondary transferring unit 18. Then, by the secondary transferring roller 19 of the secondary transferring unit 18, the toner image of full color on the intermediate transferring belt 6 is secondary transferred to the sheet. The sheet with the secondary transferred toner image is conveyed to a downstream side on the conveying path 16 to enter the fixing device 20, and then, the toner image is fixed on the sheet in the fixing device 20. The sheet with the fixed toner image is ejected from the sheet ejection port 21 on the ejected sheet tray 4.

Next, the printer main body 2 will be further described. In the printer main body 2, the secondary transferring unit 18 is housed.

Figure 2:
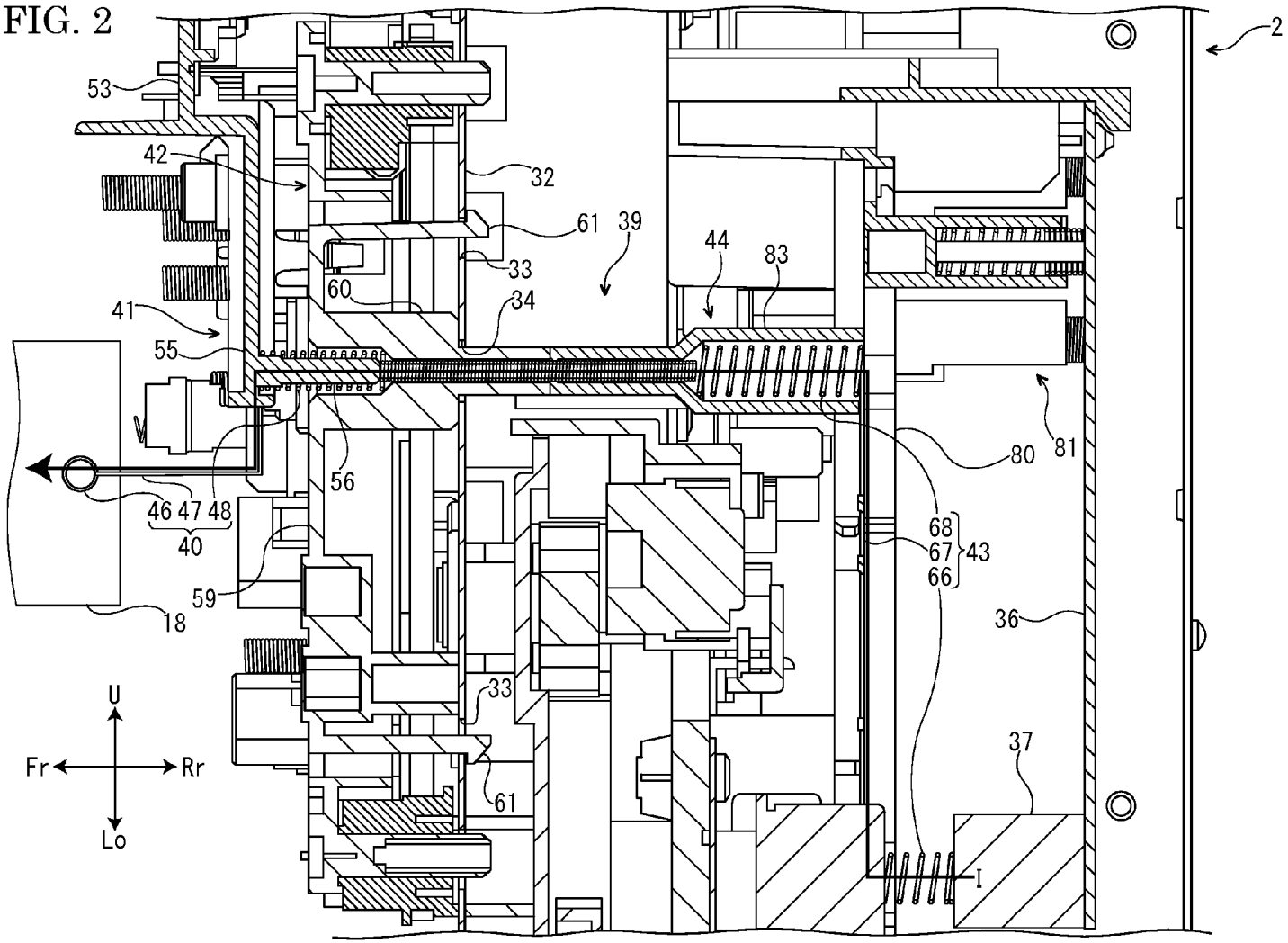
FIG. 2 is a sectional view showing a connecting mechanism and its periphery, in the color printer according to the embodiment of the present disclosure.
Figure 3:
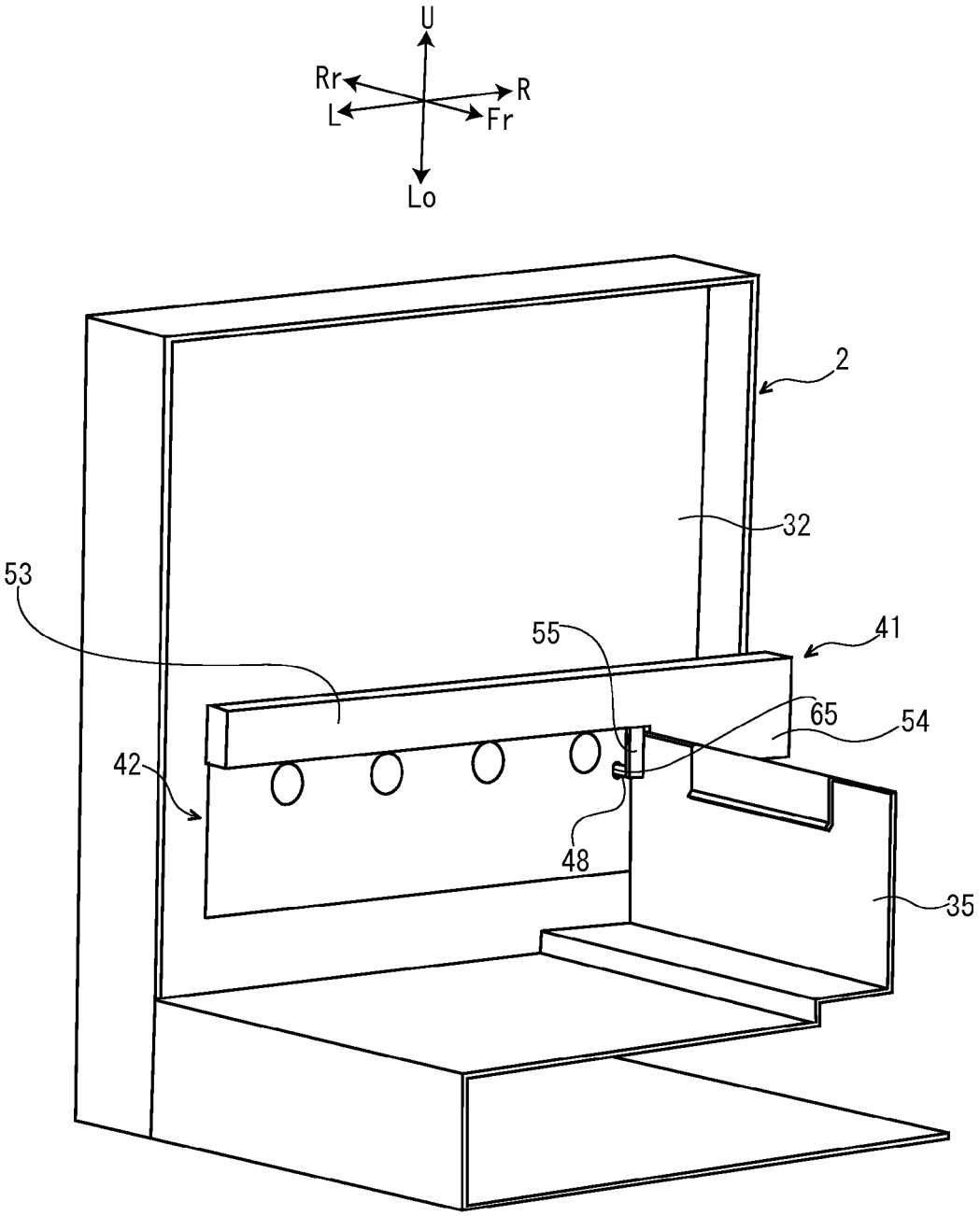
FIG. 3 is a perspective view schematically showing a printer main body, a first holding member and a coupling member, in the color printer according to the embodiment of the present disclosure.

As shown in FIG. 2, at a rear part of the printer main body 2, a rear side frame 32 is set up. The rear side frame 32 is provided with a pair of upper and lower hook holes 33, and, below the upper hook hole 33, a through hole 34 is formed. As shown in FIG. 3, at a front right side of the rear side frame 32, a side plate 35 is set up. The side plate 35 extends along front and rear direction.

Next, a high-voltage board 36 disposed in the printer main body 2 will be described.

As shown in FIG. 2, the high-voltage board 36 is set up at a rear side of the rear side frame 32 of the printer main body 2. The high-voltage board 36 is connected with a power supply board (not shown) connected to an external power supply. At a lower end part of the high-voltage board 36, a secondary transferring transformer 37 is provided.

Next, a connecting mechanism 39 which electrically connects the high-voltage board 36 and the secondary transferring unit 18 will be described.

As shown in FIG. 2, the connecting mechanism 39 includes a first connecting member 40, a first holding member 41 which holds the first connecting member 40, a coupling member 42 which is arranged at a rear side of the first holding member 41, a second connecting member 43 which is arranged at a rear side of the first connecting member 40 and a second holding member 44 which holds the second connecting member 43.

The first connecting member 40 is formed by using a conductive metal wire, for example. As shown in FIG. 2, the first connecting member 40 includes a unit-side spring terminal 46, a first spring terminal 48 which is arranged at a rear side of the unit-side spring terminal 46, and a first conductive wire 47 which connects the unit-side spring terminal 46 and the first spring terminal 48.

The unit-side spring terminal 46 is composed of a compressible coil spring. The unit-side spring terminal 46 is elongated in left and right direction (a depth direction in FIG. 2). The unit-side spring terminal 46 is in contact with the secondary transferring unit 18.

Figure 4:
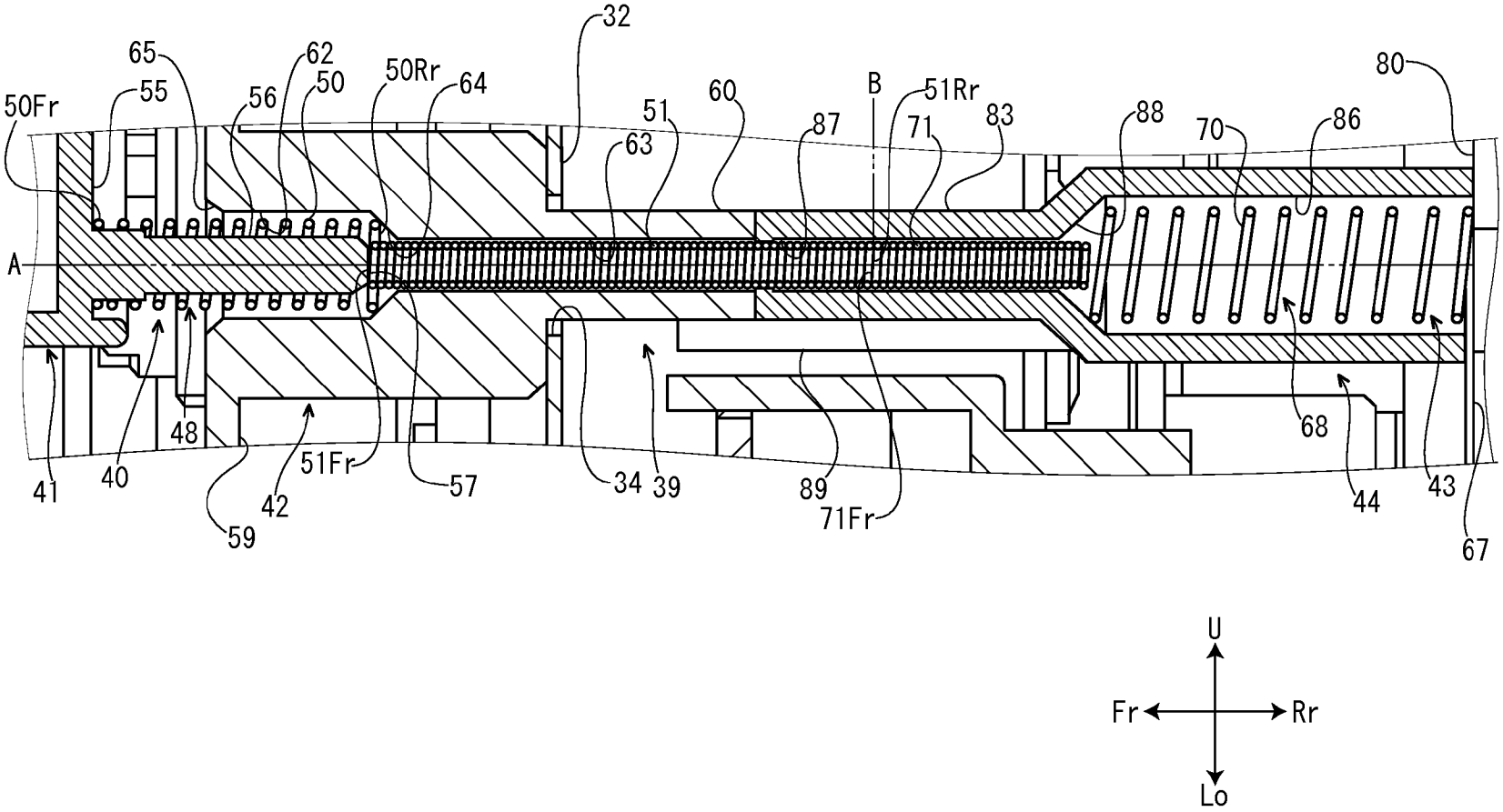
FIG. 4 is a sectional view showing first and second spring terminals and their periphery, in the color printer according to the embodiment of the present disclosure.

As shown in FIG. 4 and others, the first spring terminal 48 is provided around an axial center A elongated in the front and rear direction. That is, in the present embodiment, the axial center direction of the first spring terminal 48 is the front and rear direction. The first spring terminal 48 includes a first large diameter part 50 and a first small diameter part 51 which is provided at a rear side of the first large diameter part 50 so as to continue to the first large diameter part 50. The first large diameter part 50 is composed of a coil spring which is not tightly wound (a coil spring whose winding parts are separated from each other), and compressible in the front and rear direction. The first small diameter part 51 is composed of a tightly wound coil spring (a coil spring whose winding parts are in contact with each other), and is not compressible in the front and rear direction. The first small diameter part 51 has a smaller outer diameter than the first large diameter part 50.

Figure 5:
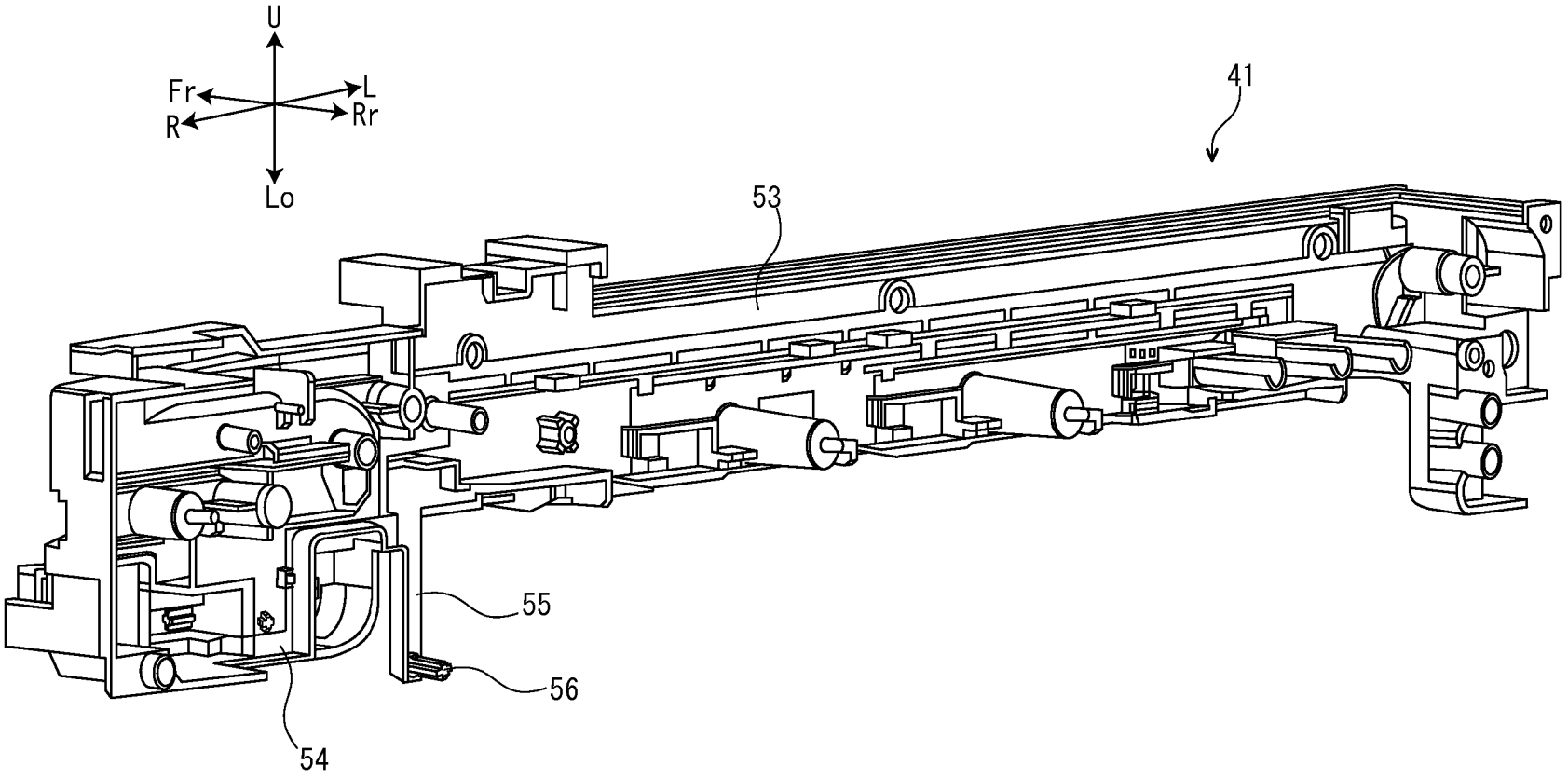
FIG. 5 is a perspective view showing the first holding member, in the color printer according to the embodiment of the present disclosure.

The first holding member 41 is made of a resin having a high electric insulating property, for example. As shown in FIG. 5, the first holding member 41 includes a first holding member main body 53 which is elongated in the left and right direction, an extending part 54 which extends downward from a right end part of the first holding member main body 53 along the upper and lower direction, a holding plate part 55 which extends downward from a right side part of the first holding member main body 53 along the upper and lower direction, and a boss part 56 which extends backward from a lower end part of the holding plate part 55 along the front and rear direction.

As shown in FIG. 4, a front end part 50Fr of the first large diameter part 50 of the first spring terminal 48 comes into contact with the holding plate part 55. The outer diameter of the boss part 56 is smaller than the outer diameter of the first large diameter part 50 of the first spring terminal 48, and is larger than the outer diameter of the first small diameter part 51 of the first spring terminal 48. To an outer circumference of the boss part 56, the first large diameter part 50 of the first spring terminal 48 is attached. On a rear end face (distal end face) of the boss part 56, the first contact part 57 is provided.

The coupling member 42 is made of a resin having a high electric insulating property, for example. As shown in FIG. 2, the coupling member 42 includes a coupling member main body 59, and a cylindrical first housing 60 which extends backward from the coupling member main body 59 along the front and rear direction.

The coupling member main body 59 includes a pair of upper and lower hooks 61. Each hook 61 engages with each hook hole 33 provided at the rear side frame 32 of the printer main body 2. Thus, the coupling member 42 is fixed to the rear side frame 32 of the printer main body 2.

The first housing 60 penetrates the through hole 34 formed at the rear side frame 32 of the printer main body 2. As shown in FIG. 4, the first housing 60 includes a first insertion part 62, a second insertion part 63 which is provided at a rear side of the first insertion part 62 and a second contact part 64 which is arranged between the first insertion part 62 and the second insertion part 63. In the first insertion part 62, the first large diameter part 50 of the first spring terminal 48 and the boss part 56 of the first holding member 41 are partially inserted. At a front end part of the first insertion part 62, an opening part 65 is formed. In the second insertion part 63, the first small diameter part 51 of the first spring terminal 48 is partially inserted. The second insertion part 63 has an inner diameter smaller than the first insertion part 62. The diameter of the second contact part 64 is gradually reduced toward the rear side (toward the side of the second insertion part 63).

The second connecting member 43 is formed by using a conductive metal wire, for example. As shown in FIG. 2, the second connecting member 43 includes a board side spring terminal 66, a second spring terminal 68 which is arranged at a front side of the board side spring terminal 66, and a second conductive wire 67 which connects the board side spring terminal 66 and the second spring terminal 68.

The board side spring terminal 66 is composed of a compressible coil spring. The board side spring terminal 66 extends along the front and rear direction. The board side spring terminal 66 is in contact with the secondary transferring transformer 37 of the high-voltage board 36.

As shown in FIG. 4, similar to the first spring terminal 48 of the first connecting member 40, the second spring terminal 68 is provided around the axial center A extending in the front and rear direction. That is, the second spring terminal 68 is arranged coaxially with the first spring terminal 48. The second spring terminal 68 includes a second large diameter part 70 and a second small diameter part 71 which is provided at a front side of the second large diameter part 70 so as to continue to the second large diameter part 70. The second large diameter part 70 is composed of a coil spring which is not tightly wound (a coil spring whose winding parts are separated from each other), and compressible in the front and rear direction. The second small diameter part 71 is composed of a tightly wound coil spring (a coil spring whose winding parts are in contact with each other), and is not compressible in the front and rear direction. The second small diameter part 71 has the outer diameter smaller than the second large diameter part 70. A front end part 71Fr of the second small diameter part 71 is in contact with a rear end part 51Rr of the first small diameter part 51 of the first spring terminal 48. That is, the front end part 71Fr of the second small diameter part 71 and the rear end part 51Rr of the first small diameter part 51 of the first spring terminal 48 form a high-voltage contact B.

Figure 6:
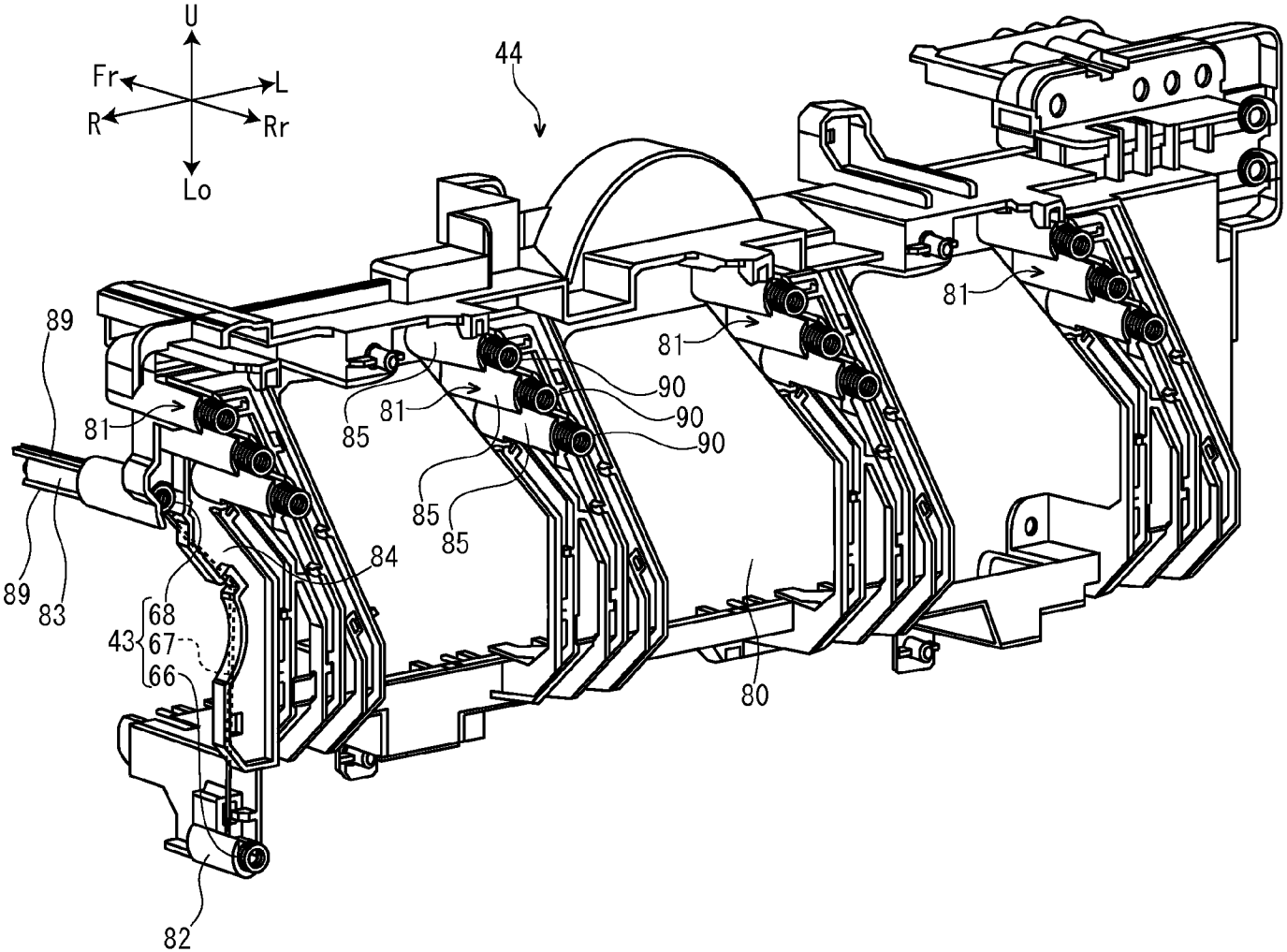
FIG. 6 is a perspective view showing a second connecting member and a second holding member, in the color printer according to the embodiment of the present disclosure.

The second holding member 44 is made of a resin having a high electric insulating property, for example. As shown in FIG. 6, the second holding member 44 includes a second holding member main body 80 which is elongated along the left and right direction, four terminal holding parts 81 which are provided at an upper part of the second holding member main body 80, a board side spring terminal housing 82 which is provided at a lower right corner part of the second holding member main body 80, and a cylindrical second housing 83 provided at a right end part of the second holding member main body 80.

At the right end part of the second holding member main body 80, a supporting plate part 84 is provided, and, at a front side of this supporting plate part 84, the second conductive wire 67 of the second connecting member 43 is arranged. Each terminal holding part 81 includes three terminal housing parts 85, and, in each terminal housing part 85, a terminal 90 is housed. In the board side spring terminal housing 82, the board side spring terminal 66 of the second connecting member 43 is housed.

Figure 7:
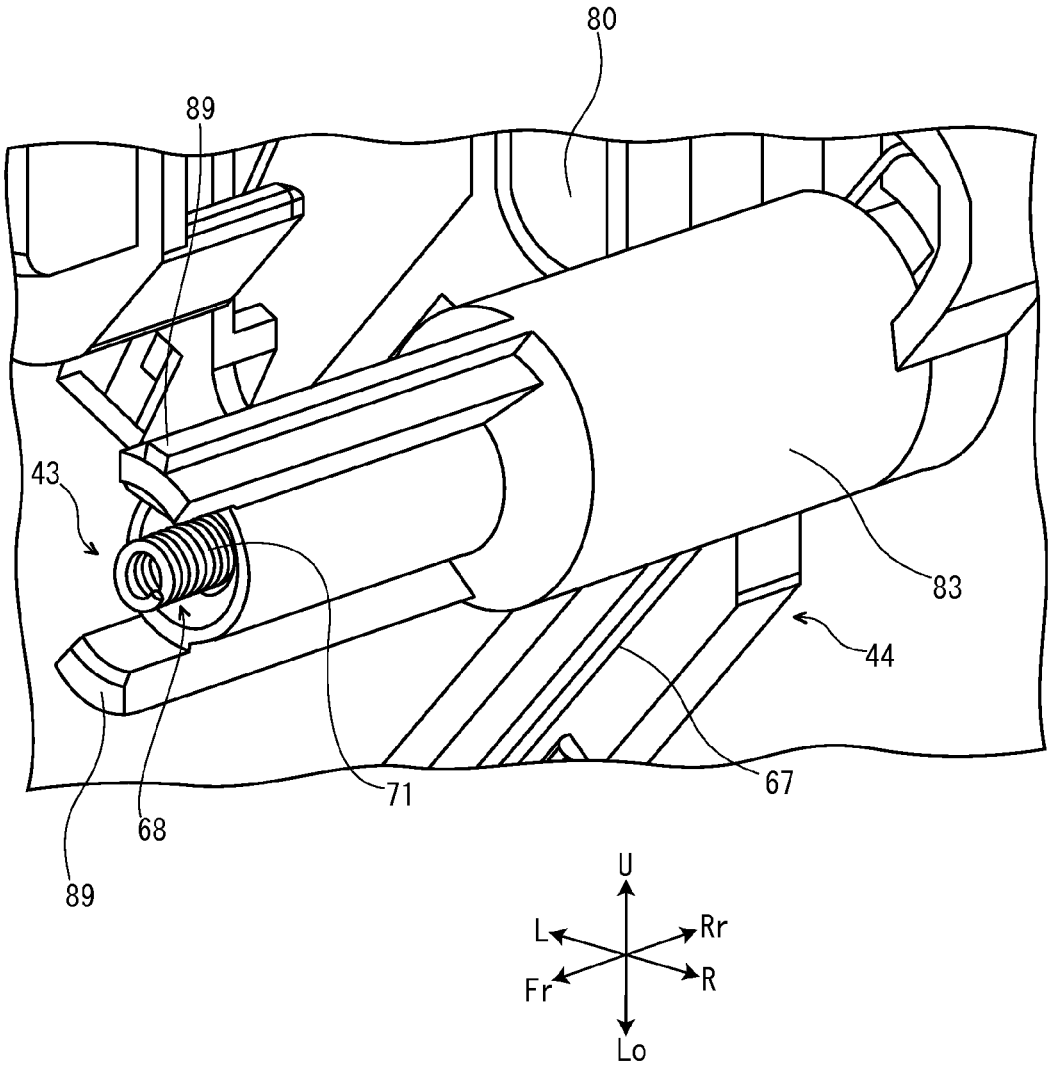
FIG. 7 is a perspective view showing the second spring terminal and its periphery, in the color printer according to the embodiment of the present disclosure.

As shown in FIG. 4, in the second housing 83, the second spring terminal 68 of the second connecting member 43 is housed. The second housing 83 includes a second large diameter part insertion part 86, a second small diameter part insertion part 87 which is provided at a front side of the second large diameter part insertion part 86, and a connection part 88 which is arranged between the second large diameter part insertion part 86 and the second small diameter part insertion part 87. Into the second large diameter part insertion part 86, the second large diameter part 70 of the second spring terminal 68 is inserted. Into the second small diameter part insertion part 87, the second small diameter part 71 of the second spring terminal 68 is inserted. The second small diameter part insertion part 87 has a smaller inner diameter than the second large diameter part insertion part 86. The diameter of the connection part 88 is gradually reduced toward the front side (to a side of the second small diameter part insertion part 87). As shown in FIG. 7, at a front end part of the second housing 83, a pair of upper and lower protrusions 89 are formed so as to protrude forward.

In the color printer 1 applying the above-mentioned configuration, an AC current supplied from the power supply board (not shown) to the high-voltage board 36 is subjected to DC conversion and high-voltage conversion and is converted into a high-voltage current by the secondary transferring transformer 37 of the high-voltage board 36. As indicated by an arrow I in FIG. 2, this high-voltage current is supplied from the secondary transferring transformer 37 of the high-voltage board 36 to the secondary transferring unit 18 through the first and second connecting members 40 and 43. Thus, the first and second connecting members 40 and 43 are arranged in a current path from the high-voltage board 36 to the secondary transferring unit 18.

Next, an assembly of the connecting mechanism 39 will be described.

Figure 8:
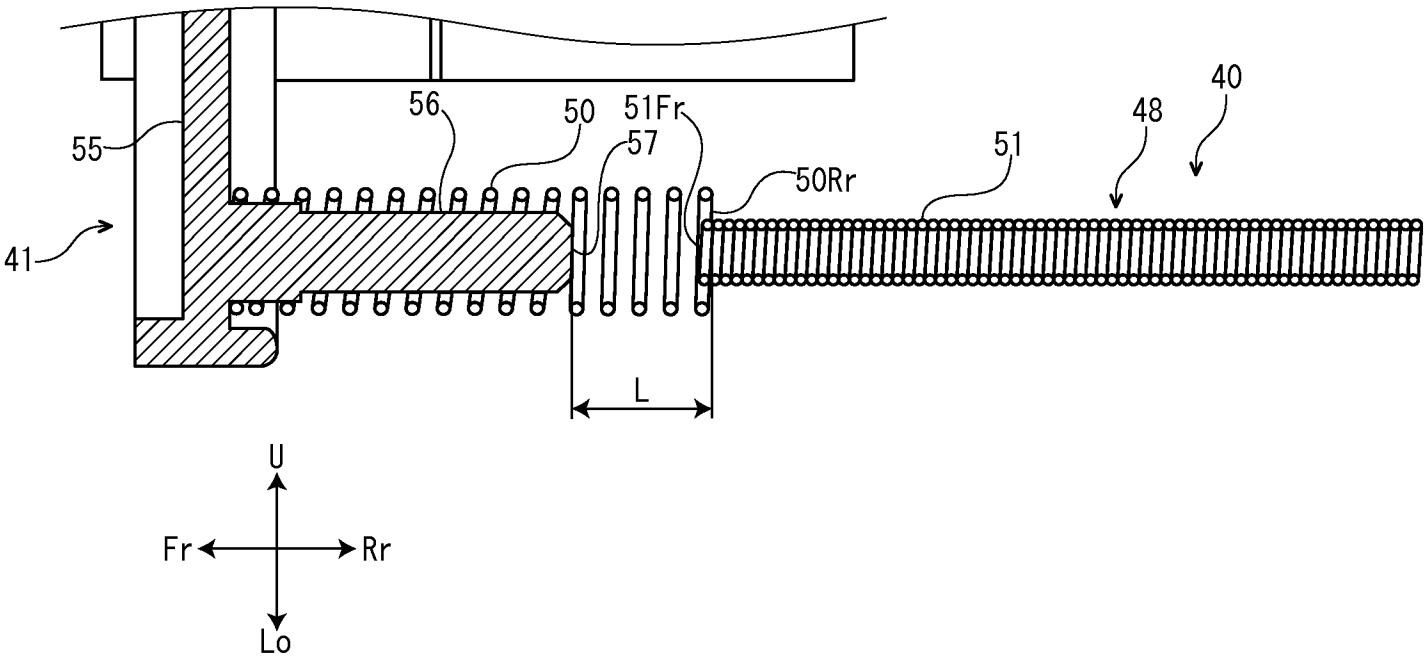
FIG. 8 is a sectional view showing the first spring terminal and its periphery in a state before the first holding member is coupled with the coupling member, in the color printer according to the embodiment of the present disclosure.

As shown in FIG. 8, in a state before the connecting mechanism 39 is assembled (a state before the first and second holding members 41 and 44 are coupled with the coupling member 42), the length of the boss part 56 of the first holding member 41 in the front and rear direction is shorter than the length of the first large diameter part 50 of the first spring terminal 48 in the front and rear direction by a length L. According to this, it is possible to freely deform the first small diameter part 51 of the first spring terminal 48 with respect to the boss part 56 of the first holding member 41. In addition, the length L is a length which allows compression of the first large diameter part 50.

Figure 9:
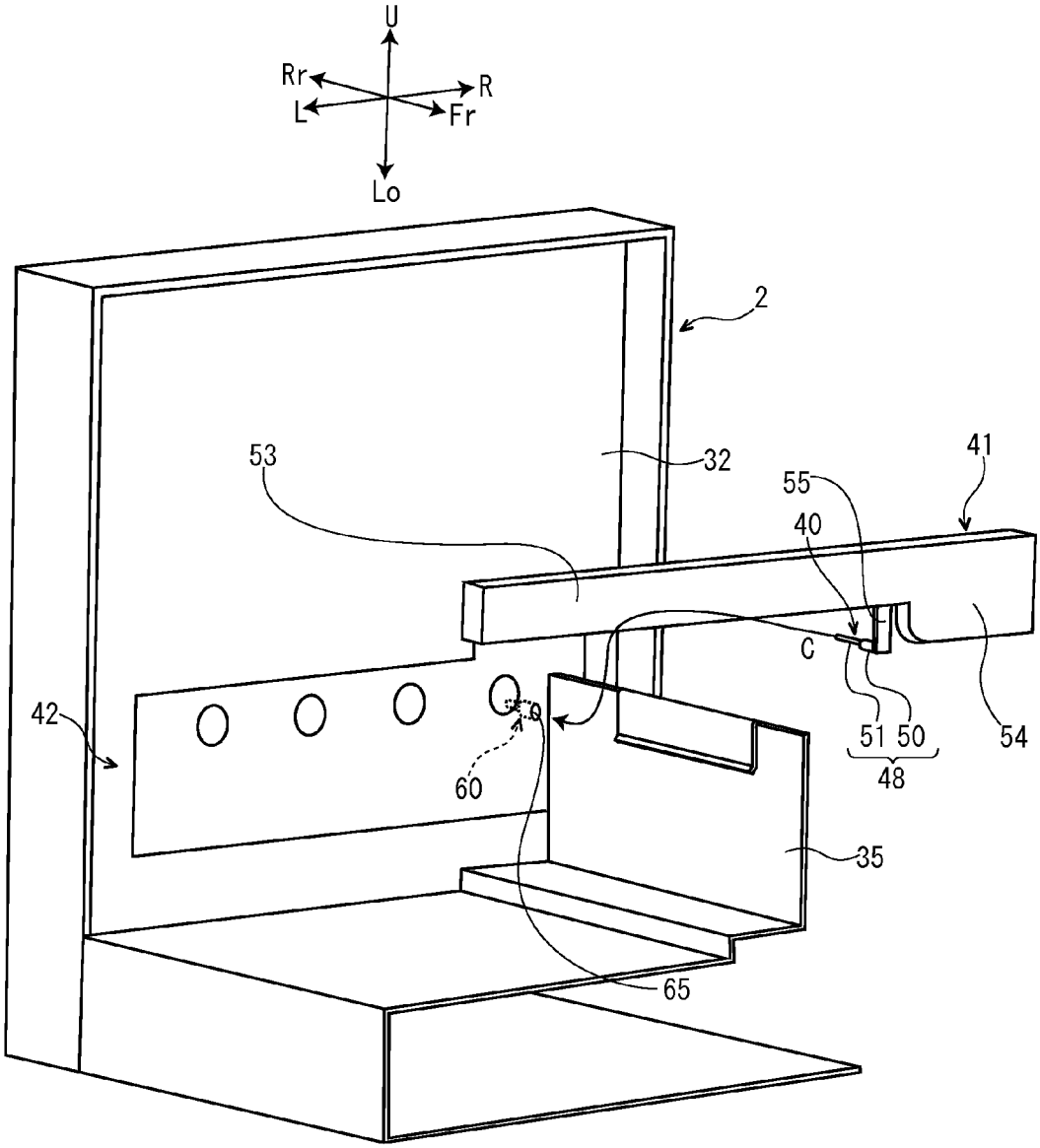
FIG. 9 is a perspective view schematically showing the printer main body, the first holding member and the coupling member in the state before the first holding member is coupled with the coupling member, in the color printer according to the embodiment of the present disclosure.

When the connecting mechanism 39 is assembled, as shown in FIG. 9, the first holding member 41 which is holding the first connecting member 40 is held at the front side of the rear side frame 32 of the printer main body 2. Further, with inserting the first spring terminal 48 of the first connecting member 40 in the first housing 60 of the coupling member 42, the first holding member 41 is coupled with the coupling member 42. In this regard, when the first holding member 41 is coupled with the coupling member 42 from the front side, the extending part 54 and the holding plate part 55 of the first holding member 41 interfere with the side plate 35 of the printer main body 2. Hence, as indicated by an arrow C in FIG. 9, the first holding member 41 is coupled with the coupling member 42 from the upper front side.

Figure 10:
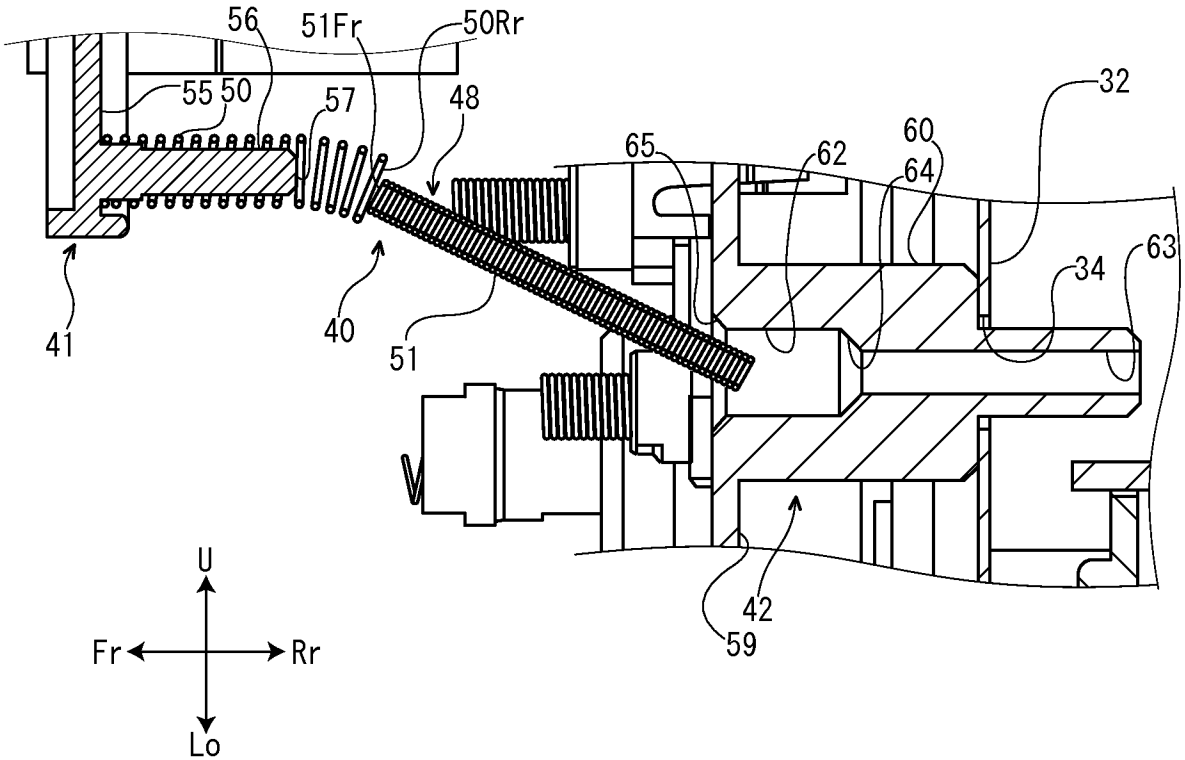
FIG. 10 is a sectional view showing the first spring terminal and its periphery in a state right before the first holding member is coupled with the coupling member, in the color printer according to the embodiment of the present disclosure.

In this case, it is possible to freely deform the first small diameter part 51 of the first spring terminal 48 with respect to the boss part 56 of the first holding member 41 as described above. Consequently, as shown in FIG. 10, while greatly deforming the first small diameter part 51 of the first spring terminal 48 downward, it is possible to insert the first spring terminal 48 in the first housing 60 of the coupling member 42. According to this, it is possible to easily insert the first spring terminal 48 in the first housing 60, and easily coupling the first holding member 41 to the coupling member 42.

Figure 11:
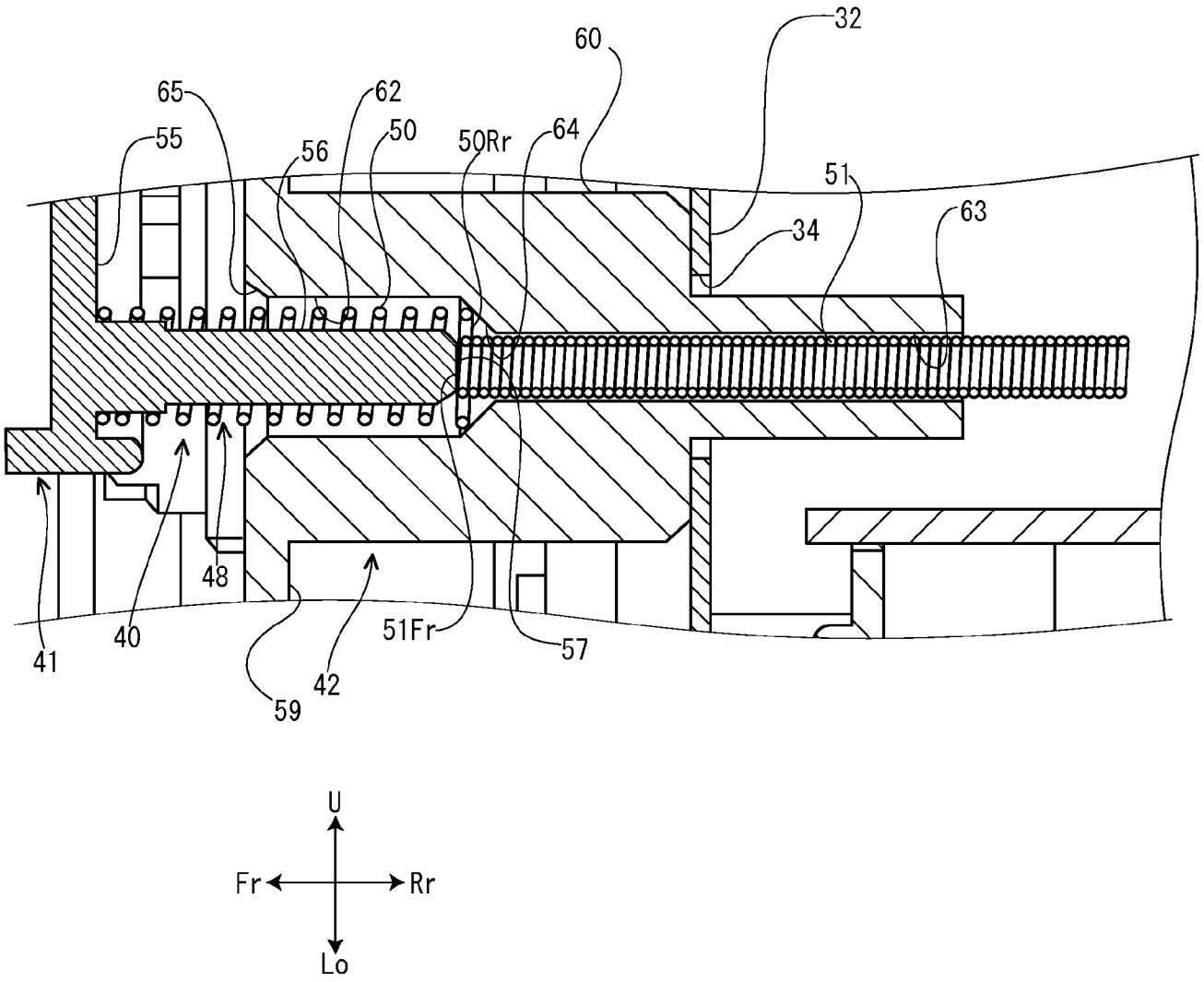
FIG. 11 is a sectional view showing the first spring terminal and its periphery in a state where the first holding member is coupled with the coupling member, in the color printer according to the embodiment of the present disclosure.

When the first holding member 41 is coupled with the coupling member 42, as shown in FIG. 11, the first large diameter part 50 of the first spring terminal 48 is partially inserted into the first insertion part 62 of the first housing 60, and the first small diameter part 51 of the first spring terminal 48 is partially inserted into the second insertion part 63 of the first housing 60. Further, when a rear end part 50Rr of the first large diameter part 50 and the second contact part 64 of the first housing 60 come into contact with each other so as to compress the first large diameter part 50, a front end part 51Fr of the first small diameter part 51 and the first contact part 57 of the boss part 56 of the first holding member 41 come into contact with each other. According to this, the elastic force of the first large diameter part 50 stops working on the first small diameter part 51, and movement of the first small diameter part 51 in the front and rear direction is restricted.

Figure 12:
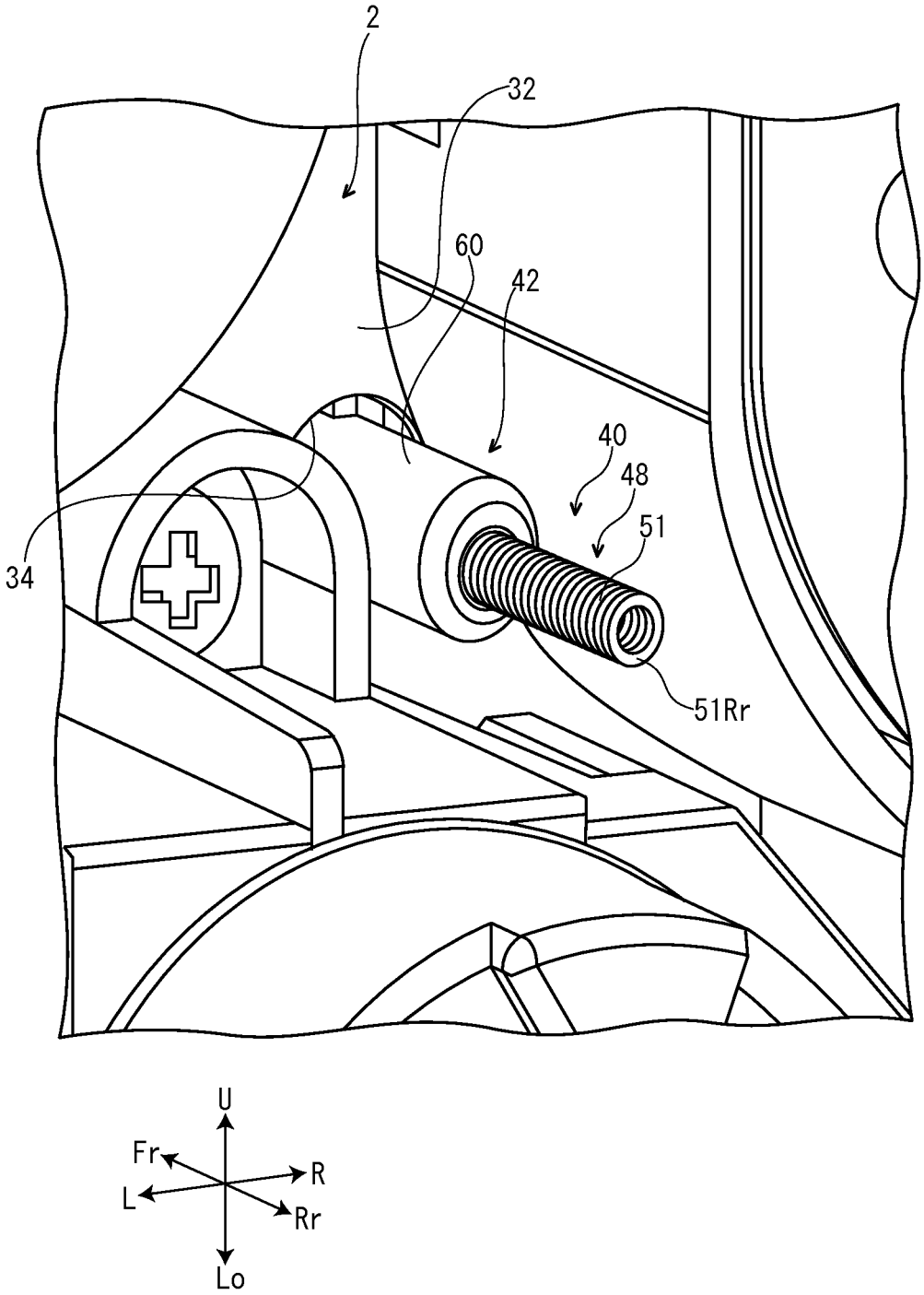
FIG. 12 is a perspective view showing the first spring terminal and its periphery in a state where the first holding member is coupled with the coupling member, in the color printer according to the embodiment of the present disclosure.

Further, when the first holding member 41 is coupled with the coupling member 42 as described above, as shown in FIG. 12, the first spring terminal 48 penetrates the first housing 60, and the rear end part 51Rr of the first small diameter part 51 of the first spring terminal 48 protrudes to the rear side of the rear side frame 32 of the printer main body 2 and the first housing 60.

Next, as shown in FIG. 4, the front end part of the second housing 83 of the second holding member 44 is placed to come into contact with the rear end part of the first housing 60 of the coupling member 42 so as to couple the second holding member 44 to the coupling member 42. According to this, the rear end part 51Rr of the first small diameter part 51 of the first spring terminal 48 is inserted into the second small diameter part insertion part 87 of the second housing 83 so as to come into contact with the front end part 71Fr of the second small diameter part 71 of the second spring terminal 68. Thus, the high-voltage contact B formed by the first small diameter part 51 and the second small diameter part 71 is formed in the second small diameter part insertion part 87 of the second housing 83. Consequently, it is possible to prevent misalignment of the second holding member 44 with respect to the coupling member 42, and enhance a coupling strength of the coupling member 42 and the second holding member 44.

In the present embodiment, as described above, the first holding member 41 is provided with the first contact part 57 which comes into contact with the front end part 51Fr (the end part at the side of the first large diameter part 50) of the first small diameter part 51 of the first spring terminal 48 in a state where the first holding member 41 is coupled with the coupling member 42, and the coupling member 42 is provided with the second contact part 64 which comes into contact with the rear end part 50Rr (the end part at the side of the first small diameter part 51) of the first large diameter part 50 of the first spring terminal 48 in a state where the first holding member 41 is coupled with the coupling member 42. By applying this configuration, it is possible to prevent a spring pressure of the first spring terminal 48 from having influence on the pressure of the high-voltage contact B composed of the first and second spring terminals 48 and 68. Hence, it is possible to set the pressure of the high-voltage contact B based only on the spring pressure of the second spring terminal 68, and easily and precisely set the pressure of the high-voltage contact B.

Further, the first contact part 57 is arranged at the rear end face (distal end face) of the boss part 56 of the first holding member 41. By applying this configuration, it is possible to form the first contact part 57 while applying a simple configuration.

Further, the second contact part 64 is arranged between the first insertion part 62 and the second insertion part 63 of the first housing 60 of the coupling member 42. By applying this configuration, it is possible to form the second contact part 64 while applying a simple configuration.

Further, the second spring terminal 68 includes the second large diameter part 70 which is composed of a compressible coil spring and the second small diameter part 71 which is composed of a tightly wound coil spring, has the smaller outer diameter than the second large diameter part 70 and is contactable with the first small diameter part 51. By applying this configuration, it is possible to reliably place the first spring terminal 48 and the second spring terminal 68 in contact with each other.

Further, in the present embodiment, the secondary transferring unit 18 which secondarily transfers a toner image on the intermediate transferring belt 6 to a sheet is used as a unit. By applying this configuration, it is possible to reliably supply a high-voltage current to the secondary transferring unit 18 from the high-voltage board 36.

In the present embodiment, the secondary transferring unit 18 including the secondary transferring roller 19 is used as a unit. In another embodiment, an intermediate transferring unit including the intermediate transferring belt 6, an exposure unit including the exposure device 7, a photosensitive drum unit including the photosensitive drum 9, a developing unit including the developing device 11 or a fixing unit including the fixing device 20 or the like may be used as a unit. That is, every unit which is used for an image forming process on the sheet may be used as a unit.

In the present embodiment, the second spring terminal 68 is composed of the second large diameter part 70 composed of the compressible coil spring and the second small diameter part 71 composed of the tightly wound coil spring. In another embodiment, the second spring terminal 68 may be composed only of a compressible coil spring.

In the present embodiment, the configuration of the present disclosure is applied to the color printer 1. In another embodiment, the configuration of the present disclosure may be applied to another image forming apparatus, such as a monochrome printer, a copying machine, a facsimile or a multifunction peripheral.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. An image forming apparatus comprising:

a unit used for an image forming process on a recording medium;

a high-voltage board configured to supply a high-voltage current to the unit; and a connecting mechanism configured to electrically connect the high-voltage board and the unit, wherein the connecting mechanism includes:

a first connecting member including a first spring terminal;

a first holding member configured to hold the first connecting member;

a coupling member with which the first holding member is coupled; and a second connecting member including a second spring terminal configured to be contactable with the first spring terminal, the first spring terminal includes:

a first large diameter part composed of a compressible coil spring; and a first small diameter part composed of a tightly wound coil spring and configured to be contactable with the second spring terminal, wherein an outer diameter of the first small diameter part is smaller than an outer diameter of the first large diameter part, and the first holding member has a first contact part configured to come into contact with an end part of the first small diameter part at a side of the first large diameter part in a state where the first holding member is coupled with the coupling member, and the coupling member has a contact portion configured to come into contact with an end part of the first large diameter part at a side of the first small diameter part in the state where the first holding member is coupled with the coupling member, wherein the coupling member includes:

a first insertion part into which at least a part of the first large diameter part is insertable; and a second insertion part into which at least a part of the first small diameter part is insertable, wherein an inner diameter of the second insertion part is smaller than an inner diameter of the first insertion part, and the contact portion is arranged between the first insertion part and the second insertion part, wherein a diameter of the contact portion is gradually reduced toward a side of the second insertion part.

2. The image forming apparatus according to claim 1, wherein the first holding member includes:

a holding plate part extending along a direction crossing to an axial center direction of the first spring terminal; and a boss part extending from the holding plate part along the axial center direction of the first spring terminal, the first large diameter part is attached to an outer circumference of the boss part, the first contact part is arranged at an end face of the boss part.

3. The image forming apparatus according to claim 2, wherein a length of the boss part in the axial center direction of the first spring terminal is shorter than a length of the first large diameter part in the axial center direction of the first spring terminal in a state before the first holding member is coupled with the coupling member.

4. The image forming apparatus according to claim 1, further comprising a second holding member configured to hold the second connecting member and coupled with the coupling member, wherein a part of the first small diameter part is inserted into the second holding member so as to come into contact with the second spring terminal in a state where the second holding member is coupled with the coupling member.

5. The image forming apparatus according to claim 1, wherein the second spring terminal includes:

a second large diameter part composed of a compressible coil spring; and a second small diameter part composed of a tightly wound coil spring and configured to be contactable with the first small diameter part, wherein an outer diameter of the second small diameter part is smaller than an outer diameter of the second large diameter part.

6. The image forming apparatus according to claim 1, further comprising an image carrier to which a toner image is primarily transferred, wherein the unit is a secondary transferring unit configured to secondarily transfer the toner image on the image carrier to a recording medium.

7. The image forming apparatus according to claim 1, wherein the second spring terminal is arranged coaxially with the first spring terminal.

8. The image forming apparatus according to claim 1, further comprising an apparatus main body configured to house the unit, wherein the coupling member is fixed to the apparatus main body.

* * * * *